US010280707B2

(12) United States Patent
Styler et al.

(10) Patent No.: US 10,280,707 B2
(45) Date of Patent: May 7, 2019

(54) SYSTEM FOR RESEALING BOREHOLE ACCESS

(71) Applicant: Dreco Energy Services ULC, Edmonton (CA)

(72) Inventors: Graham Styler, Calgary (CA); Gavin MacMillan, Bearsden (GB)

(73) Assignee: Dreco Energy Services ULC (CA)

( * ) Notice: Subject to any disclaimer, the term of this patent is extended or adjusted under 35 U.S.C. 154(b) by 176 days.

(21) Appl. No.: 14/681,681

(22) Filed: Apr. 8, 2015

(65) Prior Publication Data

US 2016/0298417 A1 Oct. 13, 2016

(51) Int. Cl.

| | |
|---|---|
| ***E21B 34/10*** | (2006.01) |
| ***E21B 34/14*** | (2006.01) |
| ***E21B 43/12*** | (2006.01) |
| ***E21B 43/25*** | (2006.01) |

(Continued)

(52) U.S. Cl.
CPC ..... *E21B 34/063* (2013.01); *E21B 34/10* (2013.01); *E21B 43/12* (2013.01); *E21B 2034/007* (2013.01)

(58) Field of Classification Search
CPC ..... E21B 34/063; E21B 34/10; E21B 34/14; E21B 2034/007; E21B 43/25; E21B 43/12
See application file for complete search history.

(56) References Cited

U.S. PATENT DOCUMENTS 5,425,424 A * 6/1995 Reinhardt ..... E21B 33/16 166/291
7,063,152 B2 * 6/2006 Yeo ..... E21B 33/16 166/285

(Continued)

FOREIGN PATENT DOCUMENTS

CA 2809946 5/2013
RU 2428561 C2 9/2011

(Continued)

OTHER PUBLICATIONS

International Search Report, PCT/CA2016/050409, dated Jun. 15, 2016.

(Continued)

*Primary Examiner* — Matthew R Buck
(74) *Attorney, Agent, or Firm* — Conley Rose, P.C.

(57) ABSTRACT

A re-closable toe sleeve is disclosed where the toe sleeve has a port allowing fluid access from the interior of the toe sleeve to the exterior of the toe sleeve. A burst disk is placed inside the port to prevent fluid access from the interior of the toe sleeve to the exterior of the toe sleeve. However upon the fluid in the interior of the toe sleeve reaching a predetermined level the burst disk is removed or otherwise modified to allow fluid access through the port. A sliding sleeve is placed within the toe sleeve so that the sliding sleeve can be moved to cover the port thereby preventing fluid access from the interior of the toe sleeve to the exterior of the toe sleeve or the sliding sleeve may be moved to uncover the port thereby allowing fluid access from the interior of the toe sleeve to the exterior the toe sleeve. The sliding sleeve is mechanically moved from the surface and is typically run into the well in the open position such that the port is uncovered by the sliding sleeve.

23 Claims, 6 Drawing Sheets

(51) Int. Cl.
*E21B 34/06* (2006.01)
*E21B 34/00* (2006.01)

(56) References Cited

U.S. PATENT DOCUMENTS 8,267,178 B1 * 9/2012 Sommers ..... E21B 34/102 166/317
8,863,850 B2 * 10/2014 Sherman ..... E21B 34/063 137/382
8,869,898 B2 * 10/2014 Xu ..... 166/271
8,978,773 B2 * 3/2015 Tilley ..... E21B 34/14 166/194
9,133,689 B2 * 9/2015 George ..... E21B 34/14
2006/0207763 A1 * 9/2006 Hofman ..... E21B 43/00 166/281
2009/0044944 A1 * 2/2009 Murray ..... E21B 43/02 166/308.1
2011/0214881 A1 * 9/2011 Newton ..... E21B 34/063 166/373
2012/0037366 A1 * 2/2012 Sherman ..... E21B 34/063 166/297
2012/0111566 A1 * 5/2012 Sherman ..... E21B 34/063 166/297
2013/0056220 A1 * 3/2013 Sommers ..... E21B 34/102 166/373
2014/0034319 A1 * 2/2014 Surjaatmadja ..... E21B 43/14 166/305.1
2014/0069652 A1 3/2014 Gay et al.
2016/0102526 A1 * 4/2016 Wind ..... E21B 33/146 166/289

FOREIGN PATENT DOCUMENTS

RU 2524219 C1 7/2014
RU 150239 U1 2/2015
SU 1717797 A1 3/1992
WO 2014043164 3/2014
WO WO 2014043164 A2 * 3/2014 ..... E21B 41/0057

OTHER PUBLICATIONS

Russian Office Action and Search Report dated Oct. 1, 2018, for Application No. RU 2017137954, and English translation.

* cited by examiner

SYSTEM FOR RESEALING BOREHOLE ACCESS

BACKGROUND

In order to produce hydrocarbons, such as oil and gas from a subterranean reservoir, either onshore or offshore, a borehole is drilled through various layers of rock in a formation. A casing may be cemented into the formation along all or part of the borehole to create a wellbore, and a production string is inserted into the wellbore to convey the hydrocarbons to the surface. In other instances, in place of cement, annular packers may be used to seal the casing to the wellbore to prevent the longitudinal flow of fluids along the exterior of the casing. The casing in many instances becomes the production tubular for the wellbore such that the annular packers or the cement isolates each formation zone or portion of a formation zone from one another.

With the casing cemented into the well or the annular packers deployed along the length of the casing, the casing is effectively sealed against allowing any fluids to flow from the formations to the interior of the casing. With the casing effectively sealed against fluid flow, positive fluid downward through the casing is limited at best without access to the exterior of the casing making it difficult if not impossible to pump a ball or a dart through the casing to actuate the toe sleeve.

Therefore access to the exterior of the casing and therethrough to the various formation zones is needed. One means of accessing the exterior of the casing is to utilize a plug and perforate operation where a plug, a setting tool, and a perforating gun sleeve are run into the well on wireline or coil tubing using gravity or a tractor to pull the tool into position. If a sleeve system is used then actuation is limited to mechanical manipulation from the surface such as by the use of coil tubing, slick line, or electric line.

It has been found that it is possible to establish sufficient fluid flow through the casing and into the adjacent formation thereby allowing the subsequent activation of sliding sleeves by dropping balls, plugs, or darts by use of pressure to establish fluid flow with the exterior the casing where the pressure required to establish fluid flow to the exterior is preset at the surface to correspond to the requirements of the well.

Once the casing is in place in the wellbore and either cemented or all of the packers actuated fluid access to the exterior is required to facilitate the subsequent activation of sliding sleeves or other tools by dropping balls, plugs, or darts. In order to provide such fluid access to the exterior of the casing a toe sleeve subassembly is installed at the bottom of the casing. The toe sleeve subassembly has at least one port through which fluid may flow thereby establishing fluid flow through the casing and allowing the activation of ball actuated tools.

The port is provided with a burst disk where the burst disk has to be of sufficient strength to maintain a predetermined pressure during other operations that may be conducted prior to the establishment of fluid flow to the exterior of the casing. In order to operate the burst disk and establish circulation in the wellbore the casing has to be pressurized to some predetermined amount in excess of the pressure required during other operations conducted prior to the establishment of fluid flow to the exterior of the casing. Once the burst disk has burst fluid may then be pumped down through the interior of the casing and into the adjacent formation allowing balls darts or plugs to be pumped down through the casing to actuate other sleeves or tools in the casing above the toe sleeve.

In many instances over the course of the life of a well it may become necessary to prevent access through many or all of the access points, such as sliding sleeves, to the exterior of the well. In instances where access is provided by sliding sleeves a tool, such as a fishing tool, may be run into the well to close each of the sliding sleeves. However since the toe subassembly is operated by means of a burst disk a bridge plug is required to be run in and an operation separate from the operation to close each of the sliding sleeves. There is a need to easily close the toe subassembly without running in a separate bridge plug.

SUMMARY

In an embodiment of the invention a valve is provided, operable from the surface, to reseal the toe subassembly. More specifically, the toe subassembly has a housing. The housing has a port where the port allows access from the interior of the housing to the exterior of housing. Within the port is placed the burst disk where the burst disk has a burst rating less than the pressure required during the casing integrity test. An interior sleeve is axially movable within the housing. The set of seals is arranged around the exterior of the interior sleeve so as to seal a portion of the annular space between the exterior of the interior sleeve in the interior of the housing such that when the interior sleeve is in the closed condition the set of seals and the interior sleeve is arranged to prevent fluid access from the interior of the casing to the exterior of the casing. The toe subassembly may be placed in the well as part of an assembly of valves such as sliding sleeves with the toe subassembly at the bottom of the assembly or closest to the bottom of the well. The casing and is run into the wellbore in the open condition where the interior sleeve does not restrict fluid access to the burst disk allowing the burst disk to be compromised upon command.

When required the interior sleeve may be moved by a fishing tool conveyed into the well on wireline however other means of closing the toe sleeve may be used. The interior sleeve is provided with a profile such that a tool, including the fishing tool, can be run into the well, latch into the profile, and shift the interior sleeve so that fluid access is no longer provided through the port to the exterior of the casing. If so required the profile may be again utilized to shift the sleeve so that the port again provides fluid access to the exterior of the well.

DETAILED DESCRIPTION

The description that follows includes exemplary apparatus, methods, techniques, or instruction sequences that embody techniques of the inventive subject matter. However, it is understood that the described embodiments may be practiced without these specific details.

Figure 1:
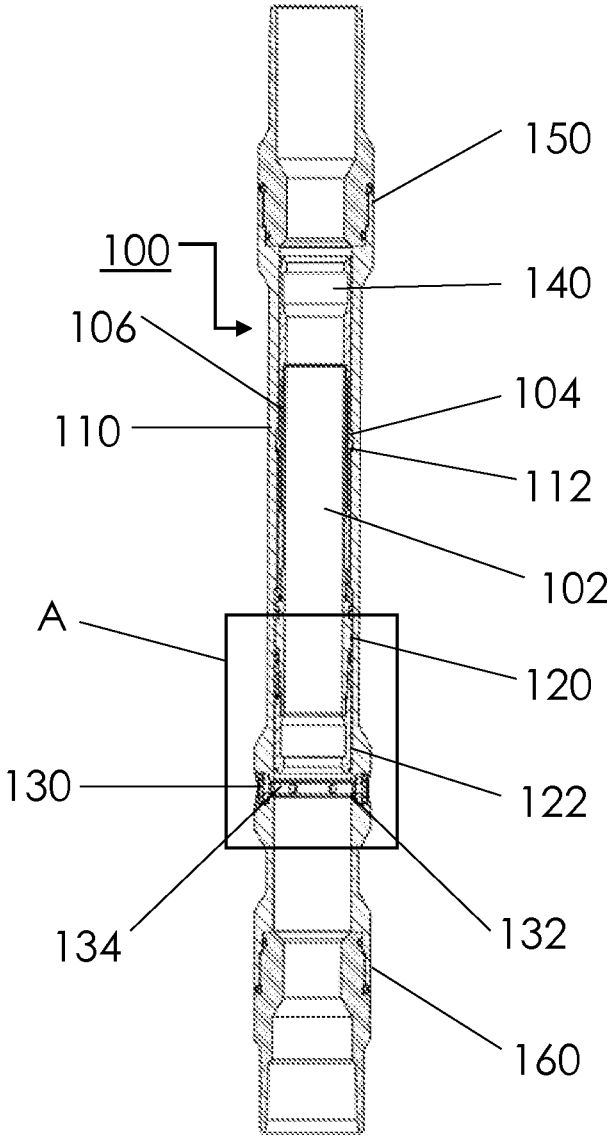
FIG. 1 depicts a toe subassembly in its run-in condition.

FIG. 1 depicts a toe subassembly 100 in the configuration where it is run into the wellbore. The toe subassembly 100 has a housing 110, an interior sleeve 120, a port 134, a burst port subassembly 130 residing in port 134, a profile 140, an upper end 150, and a lower end 160. Coupled to the interior sleeve 120 is a lock ring 104, which may be a shear pin, a c-ring, or merely a protrusion on the exterior of the interior sleeve 120, resides in recess 106 in the interior surface of the housing 110. The lock ring 104 abuts shoulder 112 in recess 106 to prevent the interior sleeve 120 from inadvertently moving downward. In this run-in configuration the interior sleeve 120 is positioned in the housing 110 such that the lower end 122 of the interior sleeve 120 does not restrict fluid access from the interior 102 of the toe subassembly 100 to the interior 132 of the burst disk subassembly 130.

By allowing fluid access from the interior 102 of the toe subassembly 100 to the interior 132 of the burst disk subassembly 130 when the fluid reaches a predetermined pressure the burst disk subassembly 130 will yield thereby allowing fluid access from the interior 102 of the toe subassembly 100 through port 134 to the exterior of toe subassembly 100 and typically into an adjacent formation (not shown). In certain instances the burst disk assembly is dissolvable such that the burst disk will degrade or dissolve over time to allow fluid flow through the port 134.

Figure 2:
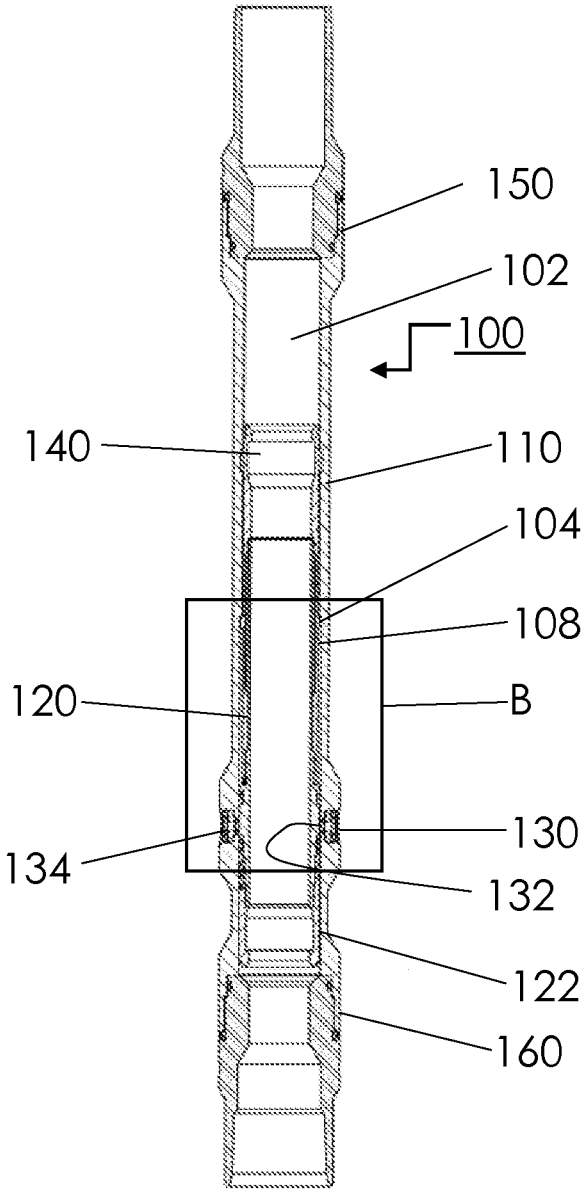
FIG. 2 depicts the toe subassembly of FIG. 1 in its closed condition.

FIG. 2 depicts the toe subassembly 100 of FIG. 1 in its closed condition with the interior sleeve 120 positioned in the housing 110 such that the interior sleeve 120 prevents fluid access from the interior 102 of the toe subassembly 100 to the interior 132 of the burst port subassembly 130.

Typically the interior sleeve 120 is moved from it running condition as depicted in FIG. 1 to its closed condition in response to well bore conditions such as the well producing excessive water. By utilizing a profile that matches a profile towards the lower end 122 of interior sleeve 120, typically on the end of a wireline, coil tubing, or other tubular to latch into profile 140. Force is then applied to interior sleeve 120 to overcome the resistance of lock ring 104 against shoulder 112 in recess 106 to shift the interior sleeve 120 downwards such that the interior sleeve 120 blocks fluid access from the interior 102 to the interior 132 a burst port subassembly 130. As shown in FIG. 2 lock ring 104 now resides in recess 108 thereby preventing the upward movement of interior sleeve 120.

Figure 3:
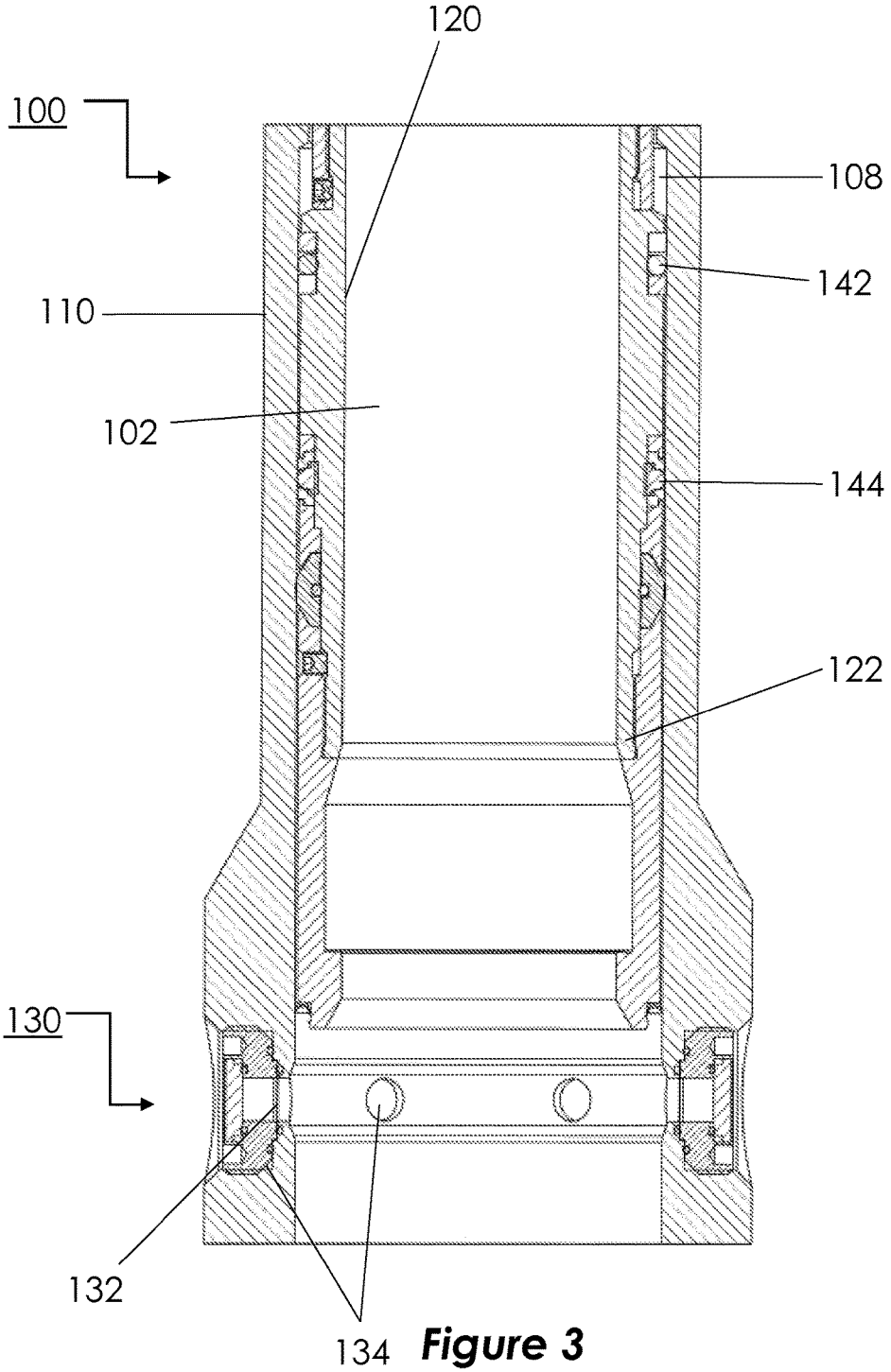
FIG. 3 depicts a close-up of the area of FIG. 1 denoted by box A.

FIG. 3 depicts a close-up of the area of FIG. 1 denoted by box A. In FIG. 3 the burst disk subassemblies 130 and the lower end 122 of interior sleeve 120 along with its sealing system are more easily described. The interior sleeve 120 is in its run-in position such that the lower end 122 of interior sleeve 120 do not block fluid access to ports 134 and thus to the interior 132 of burst disk subassemblies 130. The interior sleeve 120 has a first seal 142 and a second seal 144 that are longitudinally offset from each other and are retained in place about the exterior of interior sleeve 120. The first seal 142 and the second seal 144 reside in recess 108 and each form a seal between the interior sleeve 120 and the housing 110.

Figure 4:
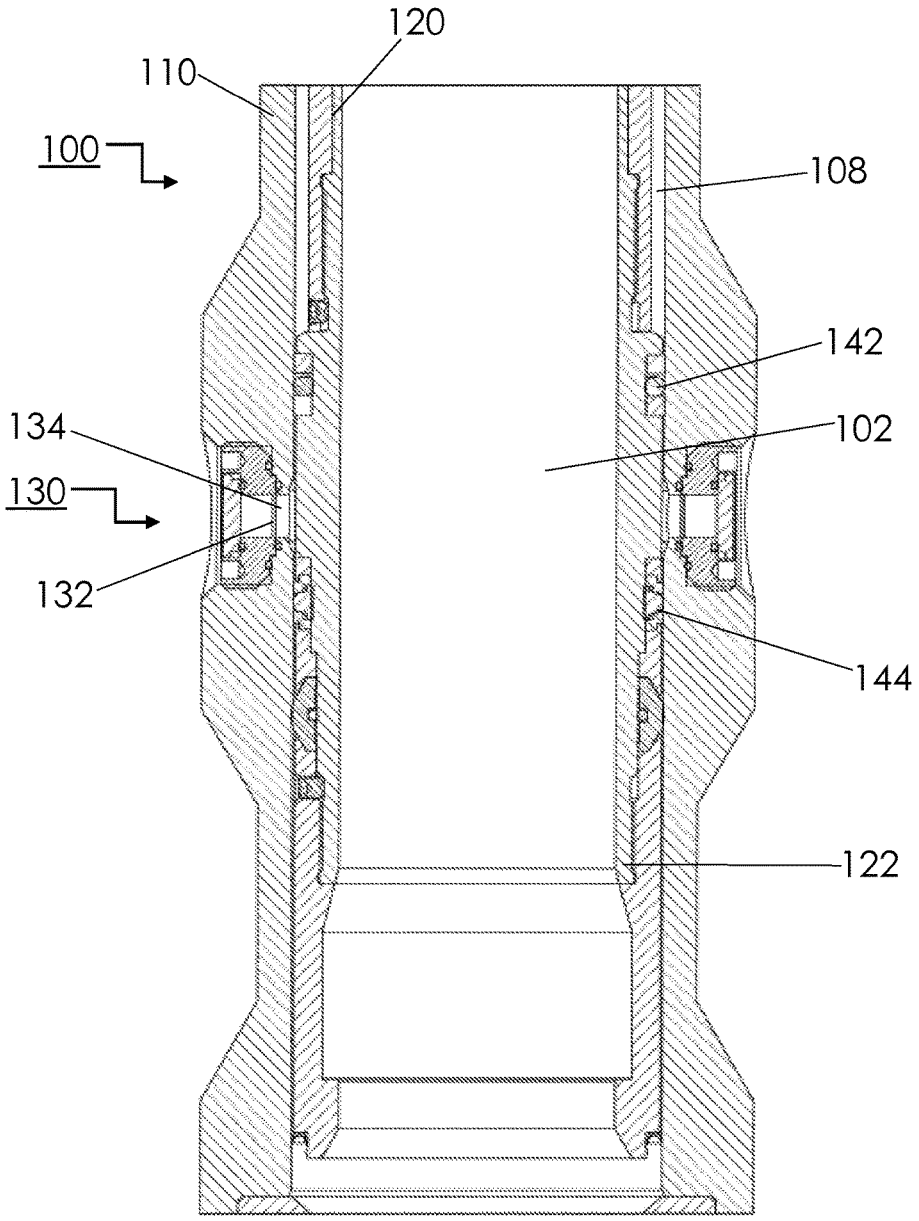
FIG. 4 depicts a close-up of the area of FIG. 2 denoted by box B.

FIG. 4 depicts a close-up of the area of FIG. 2 denoted by box B. The interior sleeve 120 is in its closed position such that interior sleeve 120 blocks fluid access to ports 134. While typically the burst disk pressure has been exceeded such that the burst disk subassemblies are open FIG. 4 depicts the toe subassembly 100 with the interior sleeve 120 and it's closed position thereby preventing fluid access to the interior 132 of burst disk subassembly 130. With the interior sleeve 120 in its closed position seals 140 and 144 are in a spaced apart relation sufficient to straddle port 134 thereby sealing the interior 102 of the toe subassembly 100 against fluid access to port 134.

Figure 5:
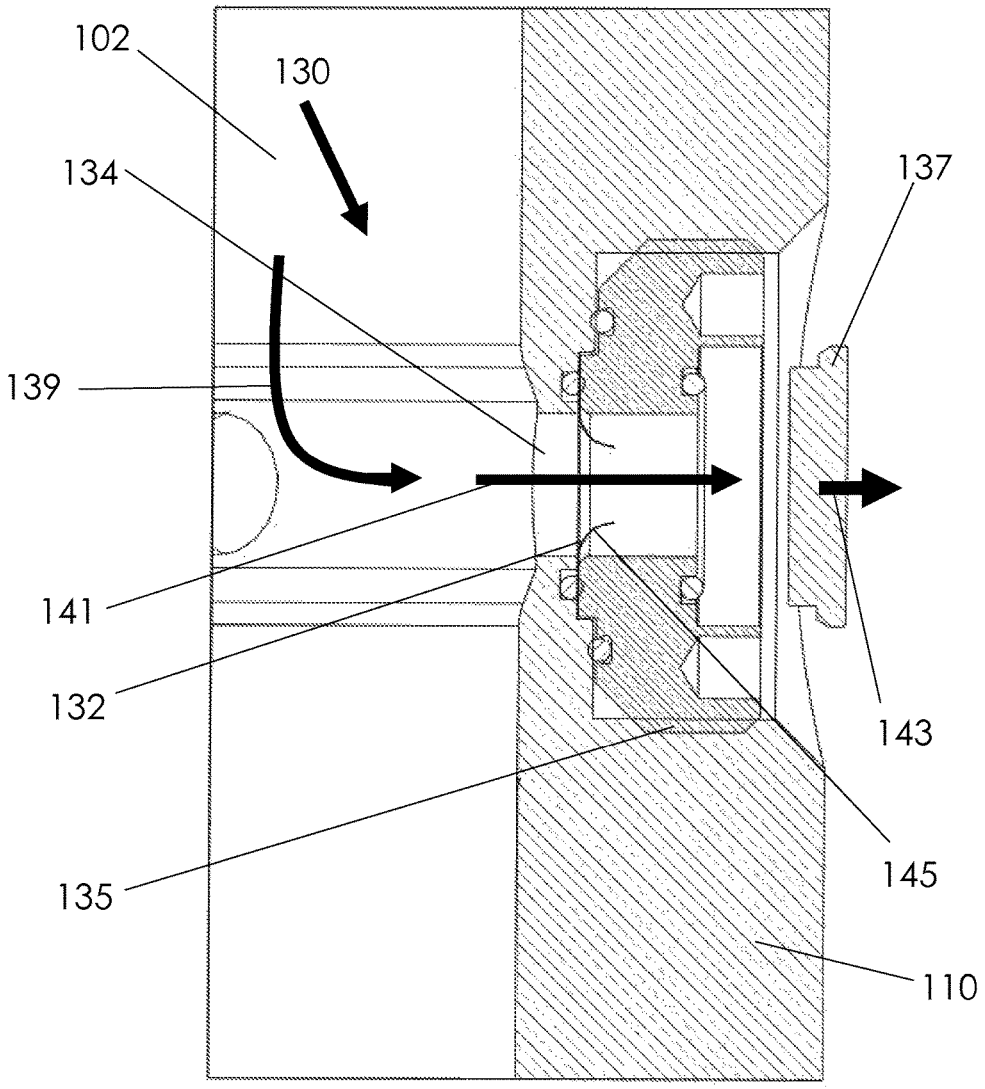
FIG. 5 depicts a burst port subassembly that has been ruptured and is open to fluid flow from the interior of the toe subassembly.

FIG. 5 depicts a burst port subassembly 130 that has been attached to housing 110 in port 134 by threads 135. While threads are shown, welding, press fit, or any other means of attachment may be used. The interior sleeve 120 is in its run-in position and is not shown in FIG. 5. Fluid pressure has been increased such that inner disk 145 has been ruptured and exterior pressure protection cap 137 has been forced off of its seat in the direction as indicated by arrow 143 such that fluid, as depicted by arrows 139 and 141, may flow from the interior 102 of toe subassembly 130 through port 134 and at least to the exterior of toe subassembly 130.

Figure 6:
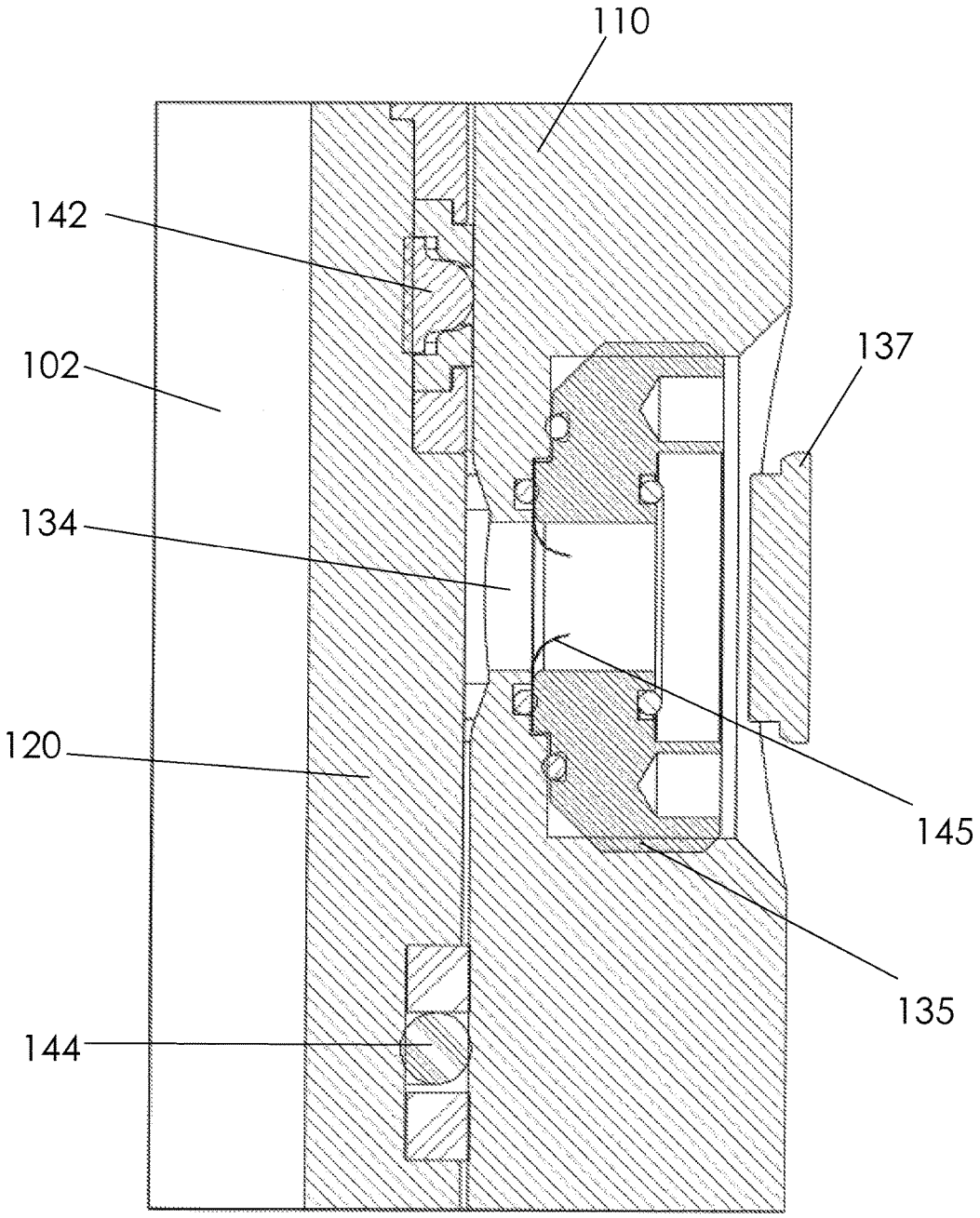
FIG. 6 depicts a burst port subassembly that has been ruptured and is closed to fluid flow from the interior of the toe subassembly.

FIG. 6 depicts a burst port subassembly 130 attached to housing 110 in port 134 by threads 135. The interior sleeve 120 is in its closed position. Seals 142 and 144 form a fluid tight seal between interior sleeve 120 and housing 110 thereby preventing fluid access from the interior 102 of toe subassembly 100 through port 134 and the now open burst disk subassembly 130 to the exterior of toe subassembly 100.

While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A valve for use in stimulation of a formation comprising:

a cylindrical housing having at least one port extending radially through a wall of the housing;

an interior sleeve disposed coaxially within the housing and selectively and repeatedly axially movable between an open position, wherein the interior sleeve does not cover the port, and a closed position, wherein the interior sleeve covers the port;

a burst disk, an atmospheric chamber, and an exterior cap mounted in the port, the atmospheric chamber disposed between the burst disk and the exterior cap, wherein, in an initial state, the burst disk is configured to block fluid flow from an interior of the housing through the port and the burst disk is further configured to rupture at a predetermined pressure difference between the interior of the housing and the atmospheric chamber;

a shifting tool to move the interior sleeve between the open position and the closed position; and a lock ring coupled to the interior sleeve, the lock ring configured to prevent movement of the interior sleeve while in the open position until the shifting tool moves the interior sleeve to the closed position and the closed position until the shifting tool moves the interior sleeve to the open position.

2. The valve according to claim 1, wherein in the initial state the interior sleeve does not cover the port.

3. The valve according to claim 1, wherein in the initial state the interior sleeve covers the port.

4. The valve according to claim 1, wherein the burst disk is configured to dissolve when exposed to a dissolving fluid.

5. The valve according to claim 1 wherein the burst disk is slot shaped.

6. The valve according to claim 1, wherein the interior sleeve includes a latch profile.

7. The valve according to claim 1, wherein the interior sleeve includes a ball seat.

8. The valve according to claim 6, wherein the shifting tool has a profile matching the profile of the interior sleeve.

9. The valve according to claim 1, further comprising a sliding sleeve valve above the valve.

10. The valve according to claim 1, further comprising a sliding sleeve valve below the valve.

11. A method for stimulating a formation, comprising:

running a tubular string into a well, the tubular string including a first valve having a housing, a port, a burst disk, an atmospheric chamber, an exterior cap, and an interior sleeve, wherein the interior sleeve is disposed coaxially within the housing and selectively and repeatedly movable between an open position where the interior sleeve does not cover the port and a closed position where the interior sleeve covers the port and the atmospheric chamber is disposed between the burst disk and the exterior cap, wherein the port extends radially through a wall of the housing, and wherein the burst disk, the atmospheric chamber, and the exterior cap are received in the port;

increasing a fluid pressure in an interior of the housing;

rupturing the burst disk at a predetermined pressure difference between the interior of the housing and the atmospheric chamber;

flowing through the port; and applying force to the interior sleeve to overcome resistance of a lock ring that is configured to prevent movement of the interior sleeve while in the open position to move the interior sleeve to the closed position.

12. The method of claim 11, wherein in the open position the interior sleeve does not cover the port.

13. The method of claim 12, further comprising moving the interior sleeve to the closed position.

14. The method of claim 11, wherein in an initial state the interior sleeve does not cover the port.

15. The method of claim 11, wherein in an initial state the interior sleeve covers the port.

16. The method of claim 11, wherein the burst disk is configured to dissolve when exposed to a dissolving fluid.

17. The method of claim 11, wherein the burst disk is slot shaped.

18. The method of claim 11, wherein the interior sleeve includes a latch profile.

19. The method of claim 11, wherein the interior sleeve includes a ball seat.

20. The method of claim 18, wherein the interior sleeve is movable between the open position and the closed position utilizing a shifting tool that includes a profile matching the profile of the interior sleeve.

21. The method of claim 11, wherein the tubular string further comprises a second valve above the first valve, the second valve including a second port, a second burst disk, and a second interior sleeve, wherein the second interior sleeve is selectively and repeatedly movable between an open position where the second interior sleeve does not cover the second port and a closed position where the second interior sleeve covers the second port.

22. The method of claim 11, wherein the tubular string further comprises a second valve below the first valve, the second valve including a second port, a second burst disk, and a second interior sleeve, wherein the second interior sleeve is selectively and repeatedly movable between an open position where the second interior sleeve does not cover the second port and a closed position where the second interior sleeve covers the second port.

23. The method of claim 11, wherein the tubular string further comprises at least a second valve.

* * * * *